US011469482B2

(12) United States Patent
Morris et al.

(10) Patent No.: US 11,469,482 B2
(45) Date of Patent: Oct. 11, 2022

(54) WAVEGUIDE ASSEMBLY HAVING A PLURALITY OF WAVEGUIDES CONNECTED BY A FLANGE INTEGRALLY FORMED WITH AT LEAST THREE WAVEGUIDE PORTS

(71) Applicant: Airbus Defence and Space Limited, Stevenage (GB)

(72) Inventors: Ian Morris, Stevenage (GB); Derek Brown, Stevenage (GB); Ian Gorecki, Stevenage (GB); Mike Webber, Stevenage (GB); Maurice Joseph Hamer, Stevenage (GB)

(73) Assignee: AIRBUS DEFENCE AND SPACE LIMITED, Stevenage (GB)

( * ) Notice: Subject to any disclaimer, the term of this patent is extended or adjusted under 35 U.S.C. 154(b) by 243 days.

(21) Appl. No.: 16/324,830

(22) PCT Filed: Aug. 7, 2017

(86) PCT No.: PCT/GB2017/052323
§ 371 (c)(1),
(2) Date: Feb. 11, 2019

(87) PCT Pub. No.: WO2018/029455
PCT Pub. Date: Feb. 15, 2018

(65) Prior Publication Data

US 2020/0274215 A1 Aug. 27, 2020

(30) Foreign Application Priority Data

Aug. 10, 2016 (GB) ..... 1613769
Aug. 12, 2016 (GB) ..... 1613891

(51) Int. Cl.
*H01P 1/04* (2006.01)
*H01P 11/00* (2006.01)
*H01P 3/12* (2006.01)

(52) U.S. Cl.
CPC ..... *H01P 1/042* (2013.01); *H01P 3/12* (2013.01); *H01P 11/002* (2013.01)

(58) Field of Classification Search
CPC .. H01P 1/042; H01P 3/12; H01P 5/024; H01P 5/181; H01P 5/182; H01P 11/003
(Continued)

(56) References Cited

U.S. PATENT DOCUMENTS 3,230,482 A * 1/1966 Cohn ..... H01P 5/182 333/113
4,812,788 A * 3/1989 Wong et al. ..... H01Q 3/40 333/113

(Continued)

FOREIGN PATENT DOCUMENTS

EP 0394795 A1 10/1990
JP S594301 Y2 2/1984

OTHER PUBLICATIONS

International Preliminary Report on Patentability (PCT/IPEA/409) dated Oct. 29, 2018, by the European Patent Office as the International Searching Authority for International Application No. PCT/GB2017/052323.

(Continued)

*Primary Examiner* — Benny T Lee
(74) *Attorney, Agent, or Firm* — Buchanan Ingersoll & Rooney PC

(57) ABSTRACT

A waveguide assembly for a radio frequency (RF) signal network can include a plurality of waveguides, wherein at least two of the plurality of waveguides are integrally formed with each other. A satellite payload can include the (Continued)

waveguide assembly, a method of manufacturing a waveguide assembly, and a method of manufacturing a signal network. Also provided is a waveguide connector having a flange, and a plurality of ports, wherein the flange can couple to a further waveguide connector, each port of the plurality of ports being configured to interface with a respective waveguide.

15 Claims, 11 Drawing Sheets

(58) Field of Classification Search
USPC ..... 333/254
See application file for complete search history.

(56) References Cited

U.S. PATENT DOCUMENTS

| | | | | |
|---|---|---|---|---|
| 6,005,458 | A * | 12/1999 | Buer et al. | H01P 1/042 333/248 |
| 7,408,427 | B1 | 8/2008 | Lee-yow et al. | |
| 10,490,874 | B2 * | 11/2019 | Smith, Jr. et al. | H01P 5/08 |
| 2015/0229460 | A1 | 8/2015 | Mohamadi | |

OTHER PUBLICATIONS

International Search Report (PCT/ISA/210) dated Nov. 3, 2017, by the European Patent Office as the International Searching Authority for International Application No. PCT/GB2017/052323.

Written Opinion (PCT/ISA/237) dated Nov. 3, 2017, by the European Patent Office as the International Searching Authority for International Application No. PCT/GB2017/052323.

Di Crestvolant, Vittorio Tornielli, et al., "Advanced Butler Matrices With Integrated Bandpass Filter Functions", IEEE Transactions on Microwave Theory and Techniques, Aug. 7, 2015, vol. 63, No. 10, pp. 3433-3444.

Dimitriadis, Alexandros I., et al., "Design and Fabrication of a Lightweight Additive-Manufactured Ka-band Horn Antenna Array", 2016 10th European Conference on Antennas and Propagation (EUCAP), Apr. 10, 2016, pp. 1-4.

Guan-Long, Huang, et al., "3-D Metal-Direct-Printed Wideband and High-Efficiency Waveguide-Fed Antenna Array", The Institute of Electrical and Electronics Engineers, Inc. (IEEE) Conference Proceedings, May 1, 2015, 4 pages.

* cited by examiner

WAVEGUIDE ASSEMBLY HAVING A PLURALITY OF WAVEGUIDES CONNECTED BY A FLANGE INTEGRALLY FORMED WITH AT LEAST THREE WAVEGUIDE PORTS

TECHNICAL FIELD

The present invention relates to a waveguide assembly, and particularly, but not exclusively, to the design and manufacture of a waveguide assembly for radio frequency (RF) signals, and to an interface flange for a waveguide assembly.

BACKGROUND ART

Waveguides are commonly used in a wide range of applications, for guiding a wave along a desired path. For example, in a communications satellite, it may be necessary to pass a received microwave signal through a number of components (e.g. amplifiers, filters, multiplexers) before retransmitting the signal. In this case, an electromagnetic waveguide may be used to carry the signal from one component to the next.

In conventional systems containing a large number of components and requiring a large number of interconnecting waveguides, the design of the system can become particularly complex in order to ensure that all of the required signal paths for the system can be accommodated physically. Long waveguides may be required to enable routing under, over and around other network components or waveguides, and waveguides may need to be spaced out and arranged over many spatial layers.

Conventional manufacturing processes impose constraints on the freedom of the designer of the system because complex waveguides have tight mechanical tolerances in order to achieve the desired RF performance. It must therefore be ensured that a waveguide can be physically constructed in a manner which enables such performance to be achieved. For example, the attachment of a waveguide to a system component (such as the interface flange of another waveguide, or a waveguide switch) should be performed in a manner which minimises signal loss, signal reflection (return loss), or introduction of passive intermodulation (PIM) products at the point of coupling, and therefore ease of access to the point of coupling is desirable to enable assembly tools to be applied appropriately to the waveguide and the system component. Such ease of access therefore imposes an additional spatial requirement on the system design.

Conventionally, waveguides are designed, manufactured and supplied individually, and are manually assembled together in a waveguide network using fixing tools. This approach is taken to enable the design of each individual waveguide to be optimised with respect to its performance and the transmission characteristics presented to RF signals passing through that waveguide.

As system requirements evolve, requiring increasingly complex system design, driven by requirements for higher signal bandwidth and improved performance, for example, the spatial and weight penalties associated with accommodating the required waveguides are increasingly significant. Where a complex signal network is to be used in the electronics of a satellite payload, for example, where there is a requirement for multiple beams, such penalties are particularly disadvantageous.

Conventional ways of reducing the size and the manufacturing time associated with waveguide assemblies involve the simplification of the waveguide assembly, in which waveguides are made smaller, with reduced length and/or diameter. It may also be possible to design more complex signal processing schemes, so that information can be multiplexed onto a smaller number of signals, requiring fewer waveguides, for example, but increasing the processing load of a subsequent demultiplexer.

A particular waveguide, waveguide section, or a particular assembly of waveguides, can interface, via a connector, with one or more additional waveguides, waveguide sections or waveguide assemblies in order to construct a larger assembly of waveguides, or waveguide sections, such as a waveguide network. As set out above, the nature of the waveguide interface can have a significant impact on performance. Consequently, there is a need to optimise waveguide connector design in order to optimise performance.

Waveguide connectors are typically constructed using flanges. A waveguide flange contains mechanical fixing means which are used to couple the flange to a corresponding flange attached to another waveguide section. The flanges have hollow portions through which a signal passes across the interface, each hollow portion interfacing with the interior of a respective waveguide section. In this manner, two waveguide sections can be connected via the coupling of their respective flanges, and the performance of the waveguide interface, with respect to transmission of a signal across the interface, is thus dependent on the coupling of the flanges.

Conventionally, the necessity to optimise the design of interface flanges, so as to facilitate coupling between waveguide sections, has led to the use of separate interface flanges for individual waveguides, each flange specifically configured so as to be appropriate for a particular interface. In addition, such an approach facilitates ease of access to the interface flanges.

The present invention aims to provide an improved waveguide assembly for an RF signal network, and a method of manufacturing of such an improved waveguide assembly.

SUMMARY OF THE INVENTION

According to an aspect of the present invention, there is provided a waveguide assembly for a radio frequency, RF, signal network, comprising a plurality of waveguides, wherein at least two of the plurality of waveguides are integrally formed with each other.

In some embodiments, each of the plurality of waveguides may be integrally formed with each other, further improving the design of the waveguide assembly.

At least one of the plurality of waveguides may provide mechanical support to at least one other of the plurality of waveguides, allowing the waveguide assembly to be a self-supporting structure.

A portion of at least one of the plurality of waveguides may have a rectangular or an elliptical cross-section.

At least one of the plurality of waveguides may have a variable cross-section.

At least one of the plurality of waveguides may be flexible, which can improve interface loads and can allow small adjustment of interface planes to ease assembly.

At least one of the waveguides may comprise a structure for providing mechanical strength to the waveguide.

At least one of the waveguides may comprise a structure for facilitating thermal radiation from the waveguide.

The waveguide assembly may comprise means for interfacing with another waveguide assembly.

At least one of the plurality waveguides may be integrally formed with a component of the RF signal network, which may further enable design of a compact waveguide network.

The plurality of waveguides may be arranged so that the path length of the plurality of waveguides required to provide the connectivity of the RF signal network minimises mass and/or cost and/or the production time of the waveguide assembly, and may maximise the packing density of the plurality of waveguides.

The waveguide assembly may further comprise one or more waveguide connectors, each waveguide connector having a flange, and a plurality of ports, wherein the flange comprises means for coupling to a further waveguide connector, each port of the plurality of ports configured to interface with a respective waveguide of the waveguide assembly.

The waveguide assembly and the one or more flanges of respective one or more waveguide assemblies may be integrally formed.

The plurality of ports and the coupling means may be distributed around the waveguide connector in a configuration which optimises transmission of RF signals through the plurality of ports across an interface between the waveguide connector and the further waveguide connector.

The optimisation of transmission of RF signals across the interface may be such that transmission characteristics presented by each of the plurality of ports to RF signals passing through the ports are substantially equal to each other.

The optimisation of transmission of RF signals across the interface may be such that signal loss is minimised.

The means for coupling to a further waveguide connector may be configured such that when the waveguide connector is coupled to the further waveguide connector, coupling pressure is substantially uniform across the flange of the waveguide connector, which may optimise performance.

The fixing means may comprise a V-band clamp, or a plurality of bolts.

The plurality of ports may be distributed symmetrically about the waveguide connector.

One or more of the plurality of ports may have an elliptical cross-section and/or one of more of the plurality of ports may have a rectangular cross-section.

A first plurality of waveguides may be connected to a second plurality of waveguides using a pair of the above-described waveguide connectors.

The first plurality of waveguides, the second plurality of waveguides and the pair of waveguide connectors may be integrally formed.

According to another aspect of the present invention, there is provided a satellite payload comprising an RF signal network including one or more of the above-described waveguide assemblies.

According to another aspect of the present invention, there is provided a method of manufacturing a waveguide assembly for a radio frequency, RF, signal network, comprising manufacturing a plurality of waveguides such that at least two of the plurality of waveguides are integrally formed with each other.

The plurality of waveguides may be manufactured using additive manufacturing, AM.

The method may comprise arranging the plurality of waveguides to maximise the packing density of the plurality of waveguides.

The method may comprise arranging the plurality of waveguides to minimise the path length of the plurality of waveguides required to provide the connectivity of the RF signal network.

The method may comprise arranging the plurality of waveguides so that the path length of the plurality of waveguides required to provide the connectivity of the RF signal network minimises mass and/or cost and/or the production time of the waveguide assembly.

According to another aspect of the present invention, there is provided a method of manufacturing a radio frequency, RF, signal network comprising arranging network equipment on a panel, defining connectivity between the network equipment, manufacturing one or more waveguide assemblies to achieve the defined connectivity using the above-described method, and connecting the one or more waveguide assemblies to the network equipment.

The integral formation of two or more waveguides represents the design and manufacture of a single piece assembly, which permits complex configurations to be designed in a very compact way, reducing or removing entirely the need for access for assembly of individual waveguides. It also allows seamless integration of a mechanical support structure and thermal hardware into a single assembly.

Embodiments of the present invention are based on the replacement of several individual waveguides with a smaller number of blocks of waveguide assemblies which can be designed and procured as assemblies, and then assembled before being connected into a signal network panel.

BRIEF DESCRIPTION OF THE DRAWINGS

Embodiments of the present invention will be described by way of example only, with reference to the accompanying drawings, of which:

FIG. 6B shows integral formation of waveguides with the connectors and a network component;

DETAILED DESCRIPTION OF PREFERRED EMBODIMENTS

Figure 1:
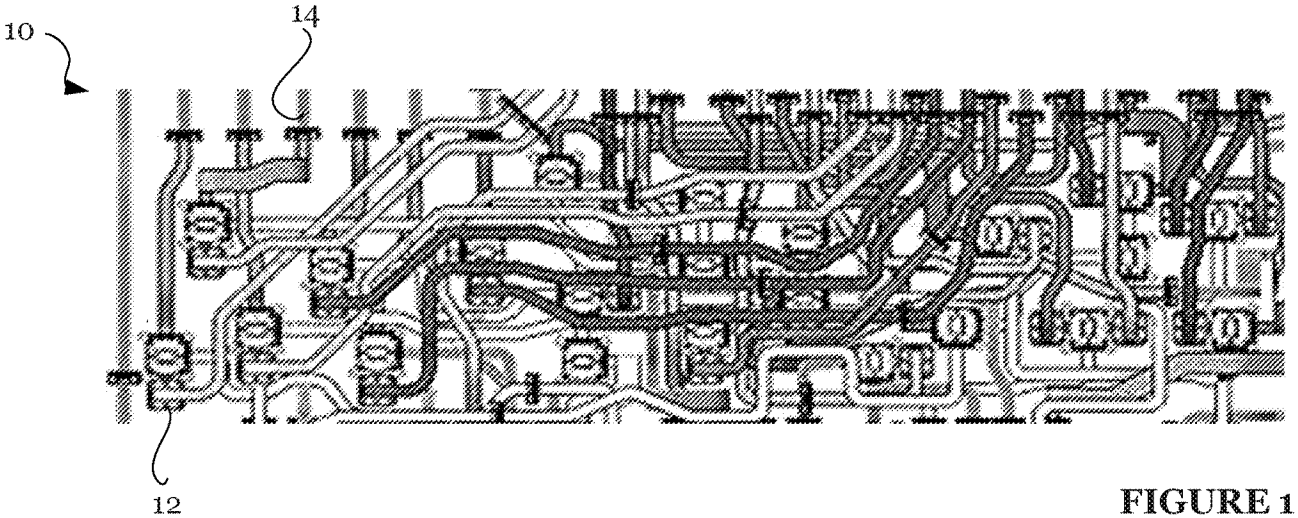
FIG. 1 illustrates an example of a plan of a partially-designed RF signal network.

FIG. 1 illustrates a plan of a partially-designed RF signal network 10. The plan illustrates a plurality of different network components 12, connected via waveguides 14 which are manufactured, supplied and assembled independently. The network components 12 may include signal amplifiers, filters, switches and the like.

As can be seen from FIG. 1, the required waveguide network 10 is complex, and some waveguide sections have particularly long path lengths. The requirement for ease of access to each waveguide and its point of coupling to either another waveguide or a network component means that the waveguides need to be spaced apart, and when the waveguides are configured over the entire network, the required waveguide routing has a large spatial footprint. During construction of a network according to the design of FIG. 1, a first waveguide may be connected to its respective network components, leaving sufficient room to route a second waveguide around the first waveguide, and subsequently route a third waveguide around both of the first and second waveguides, and so on.

Figure 2:
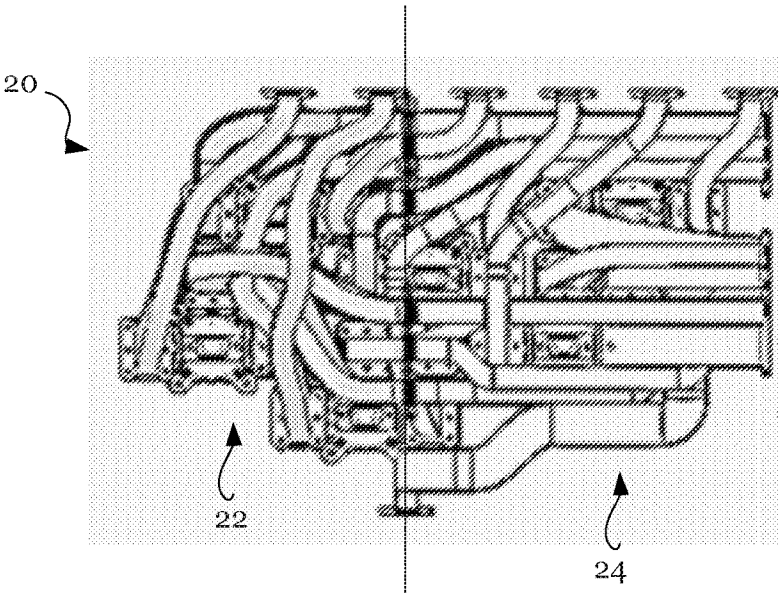
FIG. 2 illustrates a portion of a plan of a partially-designed RF signal network using waveguide assemblies configured according to an embodiment of the present invention.

FIG. 2 illustrates a portion of a plan of the RF signal network having similar functionality to that of FIG. 1, but using waveguide assemblies configured according to embodiments of the present invention. It is possible to substantially reduce the spatial footprint of the RF signal network plan in comparison to the plan shown in FIG. 2. Two waveguide assemblies 22, 24 are present, separated by a dotted line for the purposes of illustration, and the assembly designs are overlaid over the portion of the signal network corresponding to a group of network components, for the purposes of explanation. Each waveguide assembly 22, 24 is designed to connect to a particular group of network components, and the two waveguide assemblies 22, 24 interface with each other as described in more detail with reference to FIG. 3.

Accordingly, in the design of the RF signal network of FIG. 2, all of the required waveguide routing in connection with a particular block of network components is represented by the compact structure of the waveguide assembly 22, 24. To build up the signal routing needed for the entire signal network, waveguide assemblies 22, 24 as shown in FIG. 2 are connected together, rather than requiring individual waveguides to traverse multiple network components as in the configuration of FIG. 1.

Figure 10:
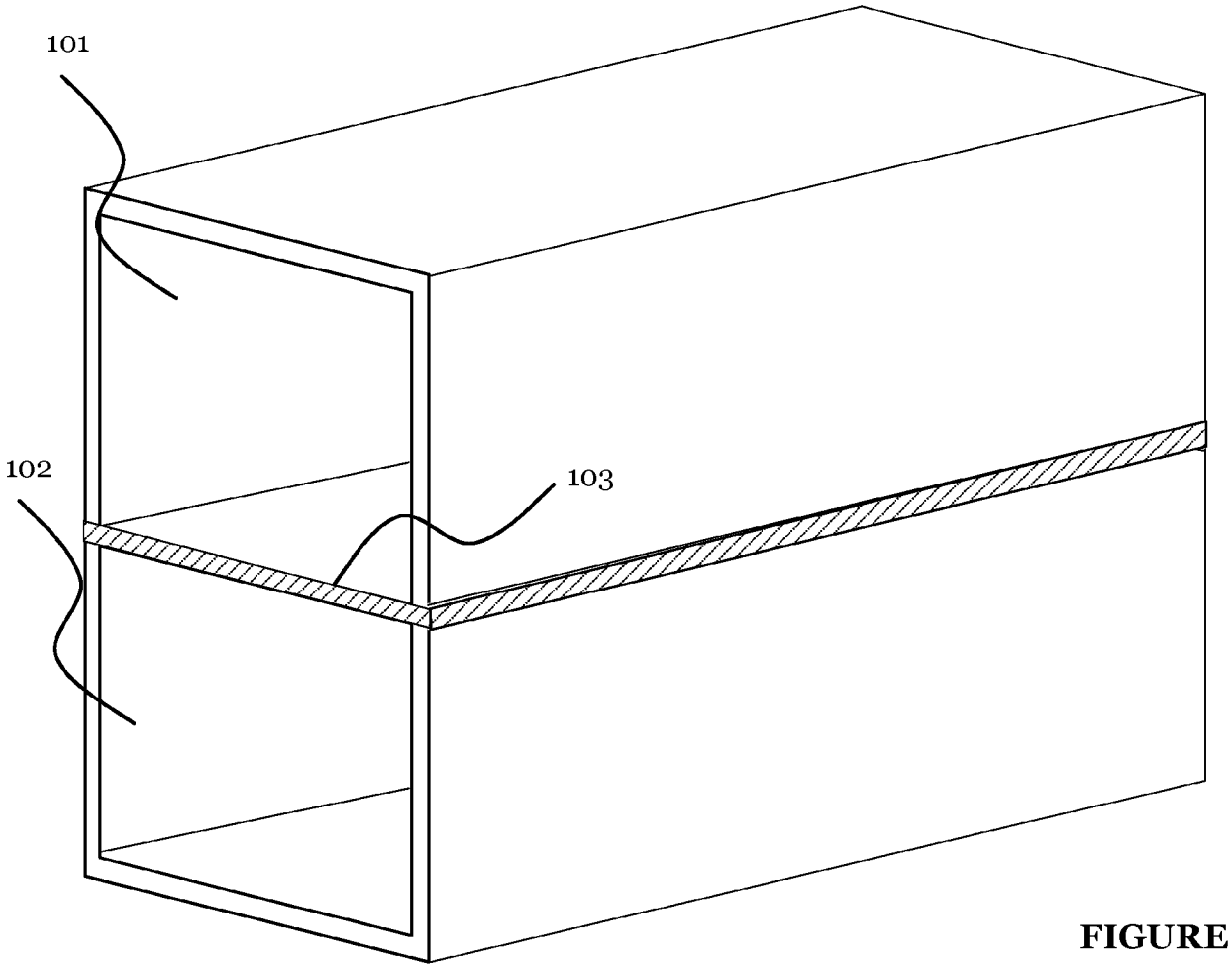
FIG. 10 shows two waveguides integrally formed and sharing a wall according to embodiments of the present invention.

Each waveguide assembly design 22, 24 contains a plurality of waveguides of different shapes, some of which are straight and others of which contain one or more bends. Waveguides may cross over each other, pass under or around each other. As represented in FIG. 10, waveguides 101, 102 may also share common walls, such as wall 103, so as to reduce overall mass. The waveguide assemblies are configured, through the design of the routing of the individual waveguides, so as to have the smallest spatial footprint on the plan. In general terms, each waveguide assembly layout is designed so as to optimise its spatial configuration in three dimensions, in view of the spatial constraints imposed by the environment in which the waveguide assembly is to be installed, such as a satellite payload.

The waveguides, once constructed, are connected to the network components so that RF signals can be routed through the signal network and transferred to other networks and/or waveguide assemblies (not shown).

Figure 3:
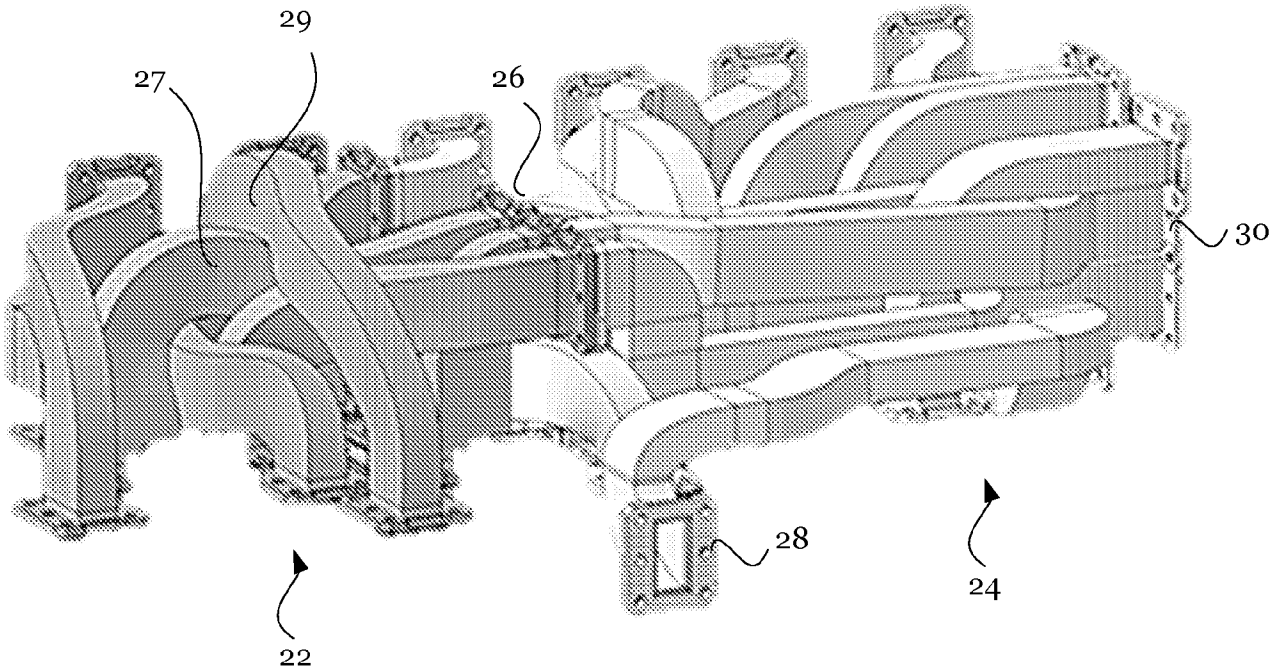
FIG. 3 is an illustration of portions of two waveguide assemblies configured according to embodiments of the present invention.

FIG. 3 is an illustration of portions of two waveguide assemblies 22, 24 of FIG. 2, configured according to embodiments of the present invention. The two assemblies are connected via interface flanges 26, such that waveguides to the left of the interface represent one waveguide assembly 22, while waveguides to the right of the interface represent another waveguide assembly 24. The interface flanges 26 contain fixing means, such as bolts, which couple the flanges together with a pressure such that signal transmission through a waveguide, across the interface, is optimised.

In addition to interface flanges 26, the waveguide assemblies 22, 24 contain component-coupling flanges 28 which are for interfacing with components such as waveguide switches. Additional interface flanges 30 are illustrated for enabling connection to further waveguide assemblies (not shown).

It can be seen from FIG. 3 that the waveguide paths and shapes differ in shape and size between waveguides, and also between different sections of the same waveguide. Waveguides may pass above, under, or around other waveguides. Self-supporting sections 27 and 29 of the assembly exhibiting the integral formation of two or more waveguides can be observed.

Figure 4:
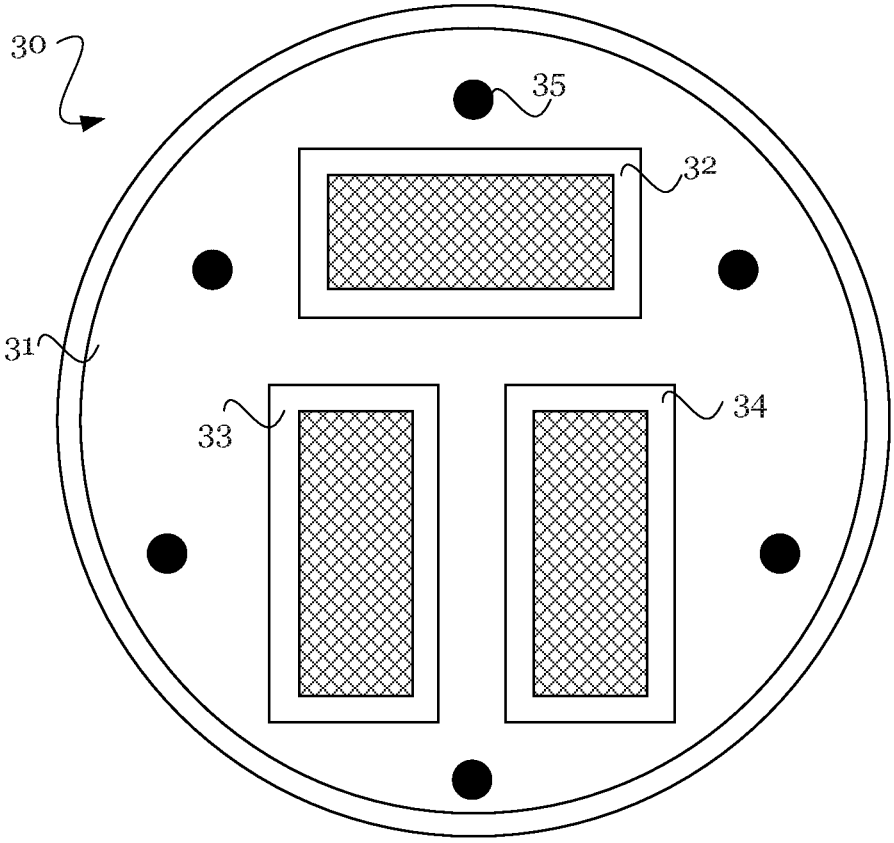
FIG. 4 illustrates a cross-section of a waveguide connector used in embodiments of the present invention.

FIG. 4 illustrates a cross-section of a waveguide connector used as an interface flange for waveguide assemblies according to embodiments of the present invention. Waveguide connectors of the form illustrated in FIG. 4 may be used to couple waveguides of the waveguide assemblies 22, 24 shown in FIGS. 2 and 3, to each other at the interface of the assemblies, as described below.

The waveguide connector 30 comprises a flange 31 and three RF signal ports 32, 33, 34. The flange comprises a plurality of bolts 35 representing means for coupling the waveguide connector 30 to another waveguide connector. In the present embodiment, the ports 32, 33, 34 and the bolts 35 are distributed symmetrically about the waveguide connector 30, although this is not an essential requirement.

Figure 5:
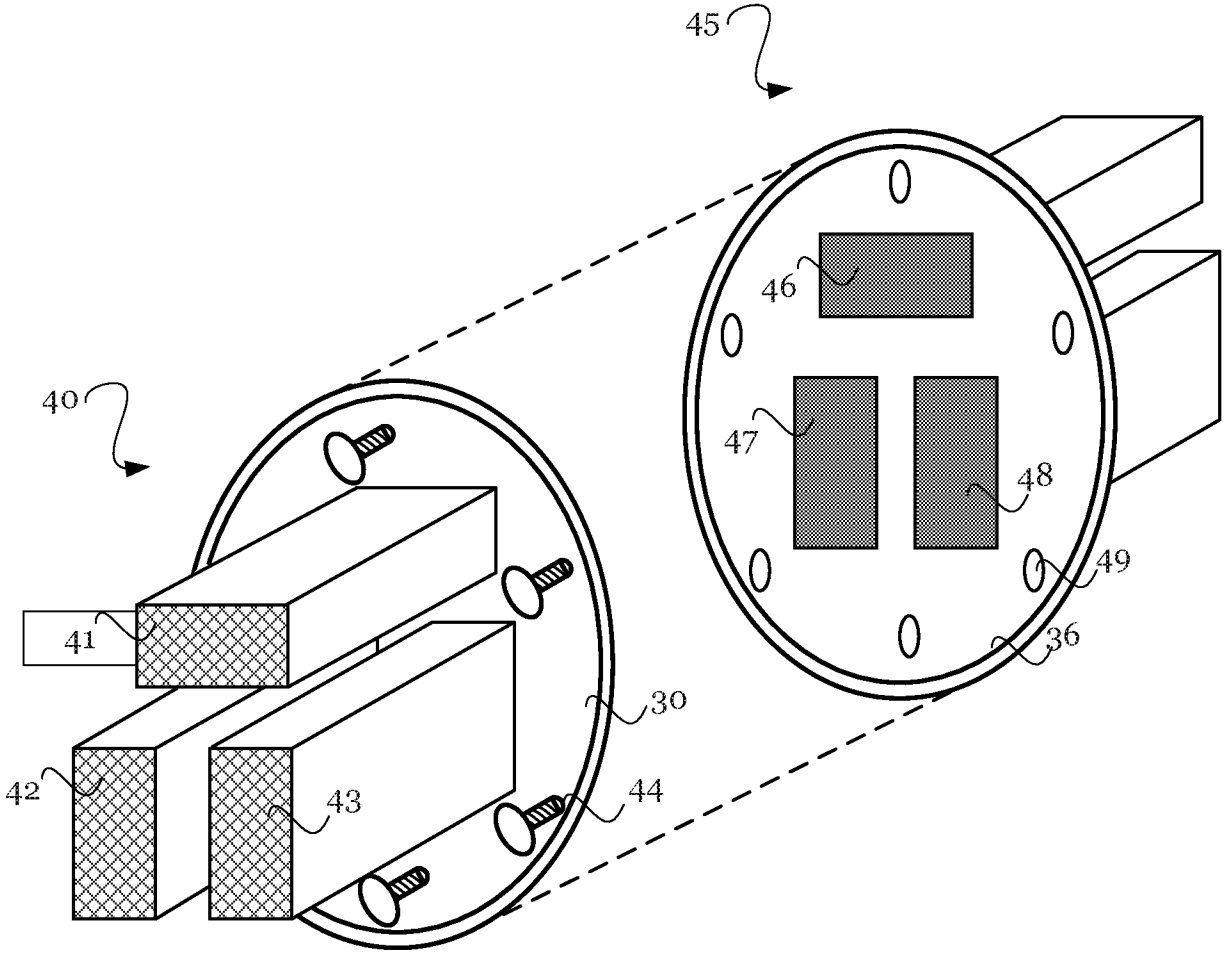
FIG. 5 is an exploded view of an interface between two waveguide connectors according to embodiments of the present invention.

The waveguide connector 30 illustrated in FIG. 4 is suitable for coupling a first group or assembly of three separate waveguide sections to a second group or assembly of three waveguide sections, as illustrated in FIG. 5. The waveguide connector 30 is coupled to each of the three waveguide sections 41, 42, 43 of the first assembly 40, while a corresponding waveguide connector 36 is coupled to each of three waveguide sections 46, 47, 48 of the second assembly 45. In the present embodiment, the waveguide connector 30 of the first assembly 40 comprises male fixing components, such as bolts 44, while the waveguide connector 36 of the second assembly 45 comprises female fixing components, such as screw-holes 49 for receiving the bolts 44, or holes through which a bolt can pass to which nuts can be attached, although in other embodiments, each of the two waveguide connectors 30, 36 may comprise a combination of male and female fixing means.

The waveguide sections 41, 42, 43, 46, 47, 48 are illustrated as straight sections in FIG. 5 for simplicity, but it is of course possible for the waveguide sections to be curved, and to cross over each other, as described above.

The two waveguide connectors 30, 36 are coupled to each other via the fixing bolts 44, establishing an interface between three pairs 41:46, 42:47, 43:48 of waveguide sections such that RF signals can propagate across the interface. Washer(s) or shim(s), made of copper of other materials, may be arranged between the two waveguide connectors 30, 36, either between each bolt 44 of one wave guide connector 30 and the flange of the opposite waveguide connector 36, or as a single washer or shim or gasket between the two flanges as a whole. The opposing surfaces of the flanges may be substantially flat, but in further modifications, the flanges of each waveguide connector may contain surface textures features which facilitate coupling, or may contain additional fixing means at their periphery, such as grooves and protrusions.

The joining of multiple waveguide sections to each other in this manner reduces the number of waveguide connectors which are required to implement a particular interface between waveguide assemblies. For the illustrated embodiment, it can be seen that six waveguide sections 41, 42, 43, 46, 47, 48 can be connected using only two connectors 30, 36, but it will be appreciated that in other embodiments, more waveguide sections can be connected via more than three ports on each of a pair of waveguide connectors. In further embodiments, each waveguide connector may comprise only two ports.

The particular arrangement of the waveguide ports and the fixing means can affect the performance of a waveguide interface implemented using waveguide connectors according to embodiments of the present invention. Performance can be measured in terms of signal loss and signal reflection at the interface, or the introduction of PIM products, and waveguide connectors used in embodiments of the present invention are configured such that signal loss and signal reflection can minimised, optimising the performance of the interface.

In some embodiments, such optimisation is achieved through maximising the coupling pressure between two waveguide connectors, by fixing corresponding flanges of a pair waveguide connectors to each other as tightly as possible. In the embodiment described above, the coupling is achieved using bolts, which may be larger than those typically used on a waveguide flange for coupling a single waveguide.

The distribution of the bolts and the ports about the connector can be designed so that a coupling force is provided evenly across the ports, which can provide a further optimisation that coupling pressure between two waveguide connector flanges can be made uniform across the interface between the two waveguide connectors. In this manner, signal transmission characteristics presented by each port to RF signals can be made to be substantially equal to each other, thus standardising the nature of the interface, which can be advantageous.

In contrast to a conventional arrangement, in which individual waveguide connectors are provided for each waveguide interface, performance can be improved through standardising the propagation of signals through different ports, since it is not necessary to manually tune each waveguide connector to achieve the same coupling force.

An example of an optimal distribution of fixing bolts, in some embodiments, is a symmetrical arrangement, in which the ports of the connector are also arranged symmetrically. Asymmetric distributions may be more appropriate in other embodiments, however, dependent on factors such as the size of each of the ports (which need not be equal to each other), and other physical constraints when the waveguide connectors are arranged in a waveguide network.

In other embodiments of the present invention, dependent on the material used for the connector flange and the number of ports present, it may not be desirable to fix flanges together as tightly as possible since this may cause non-uniformity in the flange if the flange bends or deforms at the point of fixing, which may in turn cause bending or deformation away from the point of fixing. In such cases, a fixing pressure may be desirable which is as tight as possible without distorting the flange. In alternative embodiments, the fixing bolts may be replaced by a "V-band" clamp or "V-clamp". A V-clamp is typically circular, and the internal circumference of the clamp is V-shaped, with the apex of the 'V' pointing away from the centre of the circle. The V-shaped internal circumference receives flanges having bevelled edges. As the V-clamp is tightened, the edges of the 'V'-shaped interior push on the bevelled edges and pull the flanges together.

Figure 6A:
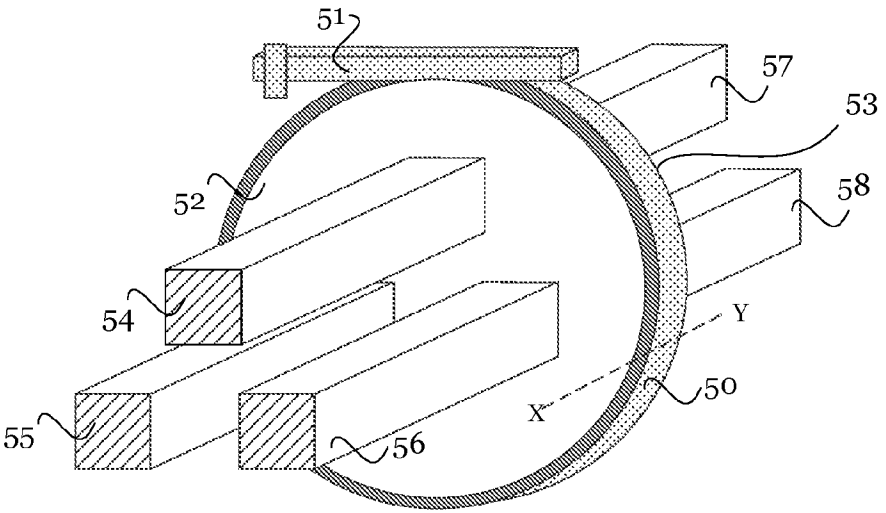
FIGS. 6A and 6B illustrate coupling of two waveguide connectors using a V-band clamp according to embodiments of the present invention, further
Figure 6B:
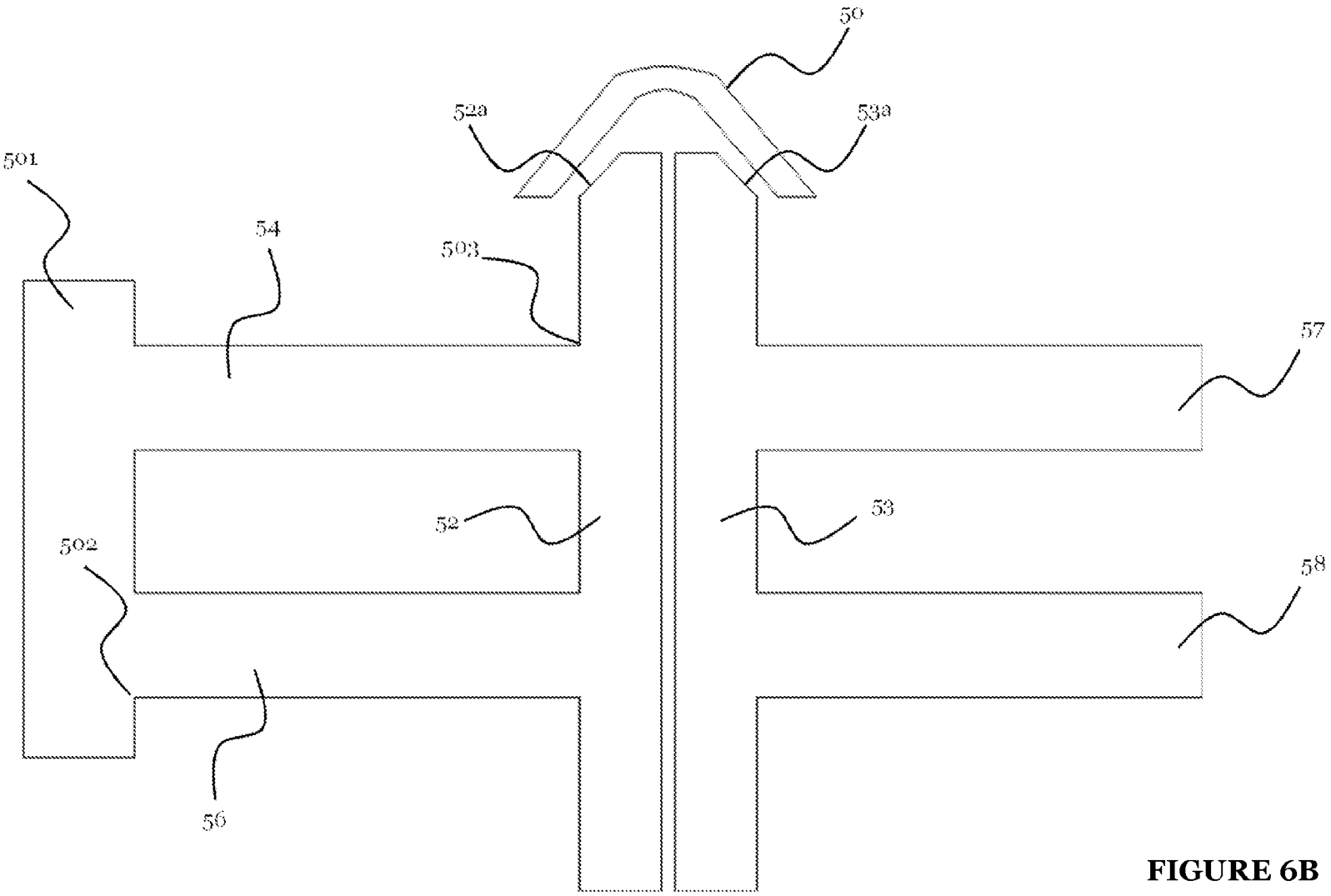

An example of such coupling is shown in FIGS. 6A and 6B, illustrating an arrangement used to link waveguide assemblies of further embodiments of the present invention. FIG. 6A is a perspective view of two flanges 52, 53, and associated waveguides 54, 55, 56, 57, 58, which are coupled by a V-clamp 50. The V-clamp contains an adjustment means 51 or adjustment gauge for controlling the tightness of the coupling. FIG. 6B further shows an example of a component 501 integrally formed with the waveguides 54, 56 at, for example, the region of integral coupling 502. FIG. 6B is a cross-section of the interface of FIG. 6A, taken along the line XY. FIG. 6B illustrates the two interfacing flanges 52, 53 and associated waveguides 54, 56, 57, 58, and the 'V'-shaped interior of the V-clamp 50. For ease of explanation, FIG. 6B illustrates a configuration in which the flanges 52, 53 are not fully brought together. As can be seen in FIG. 6B, the flanges, or connectors, 52, 53 are integrally formed with the waveguides 54, 56, 57, 58 at, for example, the region of integral coupling 503. The flanges 52, 53 have bevelled edges 52*a*, 53*a*, and as the V-clamp 50 is tightened by the adjustment means 51 as shown in FIG. 6A, the interior is brought towards the bevelled edges 52*a*, 53*a*, bringing the two flanges 52, 53 together. As the V-clamp 50 is further tightened, the flanges 52, 53 are brought together with the pressure required to establish the RF signal interface.

In the embodiments set out above, the flanges have been described as flat across the waveguide ports, but in other embodiments, it is possible for the flanges to be recessed or angled about the bolted area, or tapered towards the outer edge if using a V-clamp. Such configurations enable pressure to be increased across the RF waveguide areas. It is also possible to include a nib specifically for the purpose of controlling the amount of pressure by stopping further closure of the flange faces to each other when coupling two waveguide connectors.

In some embodiments, the flanges are configured to contain the smallest amount of material necessary to retain flange strength, so as to minimise mass. If the flanges are to be bolted, for example, the shape of the flange could be any shape which is sufficient to capture the plurality of waveguides and to accommodate the fixing bolts and has any other material removed.

Having designed each waveguide assembly so as to optimise its spatial configuration, a waveguide assembly is constructed in a manner in which two or more, and in some embodiments, all of the waveguides in the assembly, are integrally formed with each other. In the case of using waveguide connectors to enable interfacing with other waveguide assemblies, the waveguides of the assembly and one or more interface flanges of respective one or more waveguide connectors may be integrally formed. Such integral formation can be achieved using an additive manufacturing technique (AM) based on a configuration file. In AM, the waveguide assembly is constructed through deposition of successive layers of material, such as plastic or other non-metallic materials such as polymers, ceramics or resin-based materials, although in other embodiments, metals can be used, such as an $AlSi_{10}Mg$ alloy or titanium.

In some embodiments, a waveguide assembly is constructed as a standalone single-piece assembly to be connected to network components such as switches. In other embodiments, one or more network components, such as the switches, are integrated into the waveguide assembly design, so that the waveguides and network components are integrally formed as a network sub-assembly for connection to other network sub-assemblies or input/output interfaces.

Through the integral formation technique of the present invention, the physical size of a waveguide assembly as a whole is reduced in comparison with conventional systems in which waveguides are individually designed and assembled.

One reason for the reduction in size is that a waveguide assembly structure is self-supporting. In other words, one waveguide may be supported by another waveguide through the integral connection between the two waveguides, and groups of waveguides may in turn by supported in the same way by other groups of waveguides. It is thus not necessary to include a separate supporting structure, such as brackets and mounting feet, in the waveguide assembly. The integral connection between two waveguides may take the form of two waveguides being in direct physical contact, or connected via a piece of material, such as connecting fin, which is integral with each of the two waveguides. As represented in FIG. 10, another form of integral connection in embodiments of the present invention is where two or more waveguides 101, 102 share one or more walls 103.

Another reason is that it is possible to route waveguides around other waveguides through constructing portions of each of the waveguides at the same time, layer by layer, in the AM process. It is not necessary to install a first waveguide, and to subsequently route a second waveguide around the first waveguide, and subsequently route a third waveguide around both of the first and second waveguides, for example. Such a sequential process would require sufficient space to be left at each stage to enable subsequent waveguide routings which would increase the size of the overall structure, whereas such spaces are unnecessary in the technique of the present invention.

Conventional techniques of configuring waveguide assembles are generally driven by the desired end-to-end network connection requirements and are limited by spatial availability, so that waveguides are routed, such that the desired network connections can be achieved. Each waveguide is generally configured individually, and this approach often fails to take into account the possibility of introducing structural variation along the length of a particular waveguide that may further optimise performance, since it might not be possible to achieve this while at the same time enabling ease of access for connection of waveguides to network components or the introduction of additional waveguides.

Figure 8:
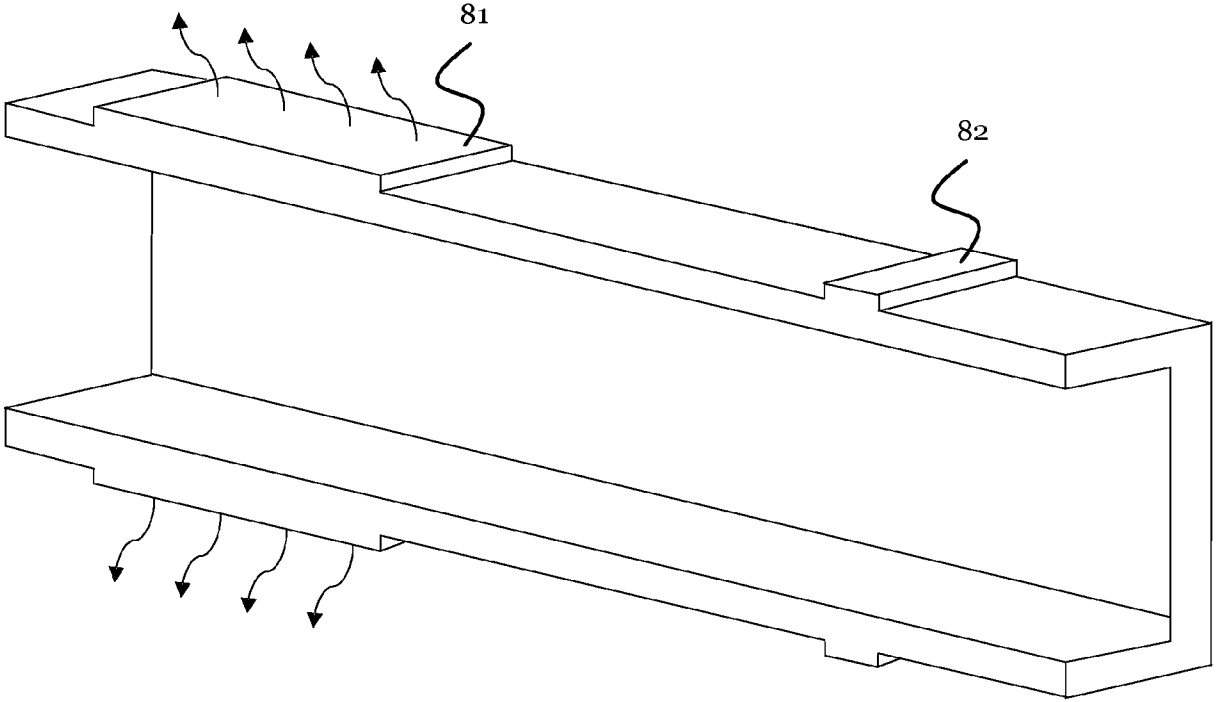
FIG. 8 shows a cross-sectional view a thermal radiator and a mechanical support rib are formed with a waveguide according to embodiments of the present invention.
Figure 11:
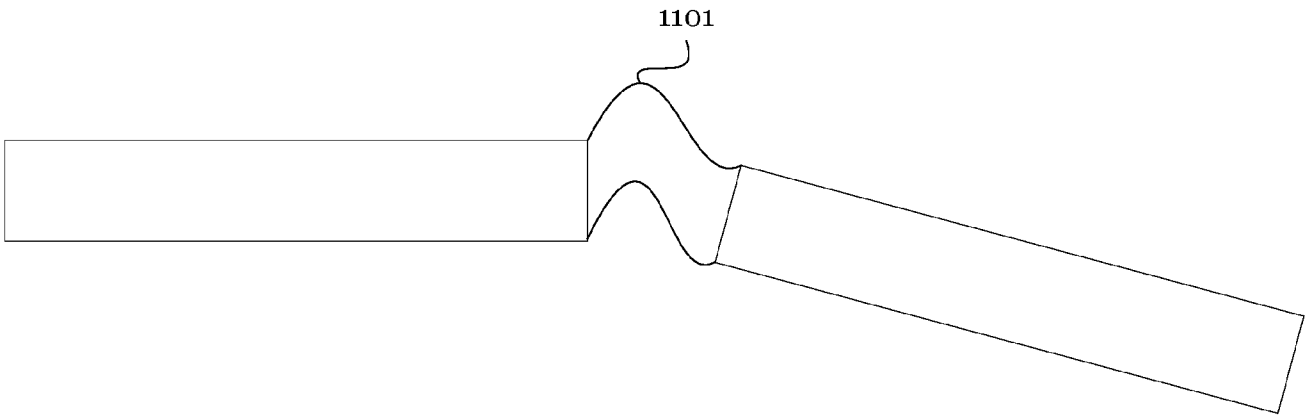
FIG. 11 shows a flexible waveguide according to embodiments of the present invention.

One potential structural variation may be variation of the thickness of waveguide walls to control thermal effects, such as dissipation of heat, in regions of a waveguide at which high temperatures might be expected. In embodiments of the present invention, it is possible to incorporate such thermal structures in the design of the waveguide assembly, and in some instances, to integrate such thermal structures with mechanical support structures. Other structural variations may relate to the inclusion of silver-plating or internal surface smoothing to reduce losses. As represented in FIG. 8, further structural variations may be the inclusion of mechanical reinforcing ribs 82 or thermal radiators 81. As represented in FIG. 11, further structural variations may include the introduction of flexible waveguide sections 1101 to improve interface loads or allow small adjustment of interface planes to ease assembly.

It is thus possible to manufacture an assembly of organically-designed waveguides, such that in addition to reductions in the size of the assembly, RF signal transmission performance is improved.

Figure 9:
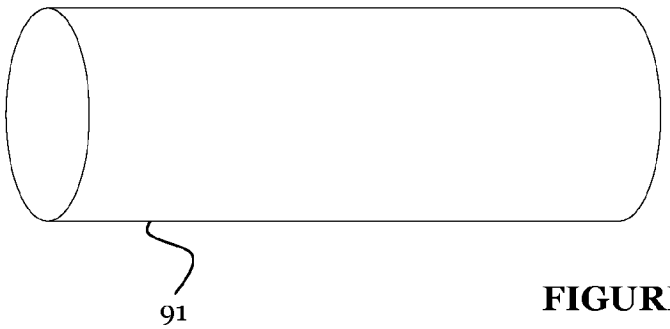
FIG. 9 shows an isometric view of an elliptical waveguide according to embodiments of the present invention.

The waveguides to be used in the waveguide assemblies of embodiments of the present invention may have rectangular and/or elliptical cross-sections 91 as represented in FIG. 9, but alternative cross-sectional profiles may be used as required for particular applications and parametric restrictions, such as the maximum permissible signal loss. The use of AM as a manufacturing technique facilitates the use of different waveguide cross-sections, also enabling transitions to be introduced between different cross-sections and sizes 29 along the length an individual waveguide, rather than being constrained by the typically fixed structures of off-the-shelf waveguides. Such transitions may enable the overall waveguide assembly to be optimised through enabling an increase in packing density and a reduction in path length, but may enable performance to be optimised through reducing insertion loss, for example. The waveguide assemblies can be similarly optimised through appropriate introduction of bends, twists and other structures to minimise the size of the assembly while maintaining mechanical integrity in the required environment. Signal loss and signal reflection at the interface between a waveguide and a connector may also be reduced as there is continuity in the material (such as plastic or metal, such as aluminium) used at the interface.

As described above, use of a technique such as AM enables the arrangements of the waveguides to be optimised, such that waveguide assemblies can be accommodated in a small volume, since conventional constraints of ensuring ease of access to portions of the assembly, to enable mechanical fixing, can be avoided. Waveguide connectors for waveguide assemblies in embodiments of the present invention are particularly advantageous because they can retain the interfacing functionality of such a reduced-size waveguide assembly, while reducing the number of physical connectors which are required. A reduction in the number of interface components further facilitates the manufacturing process, and assembly of a waveguide network from waveguide assemblies can be performed in a shorter period of time.

In the embodiment illustrated in FIG. 2, the waveguide assembly 20 of the present invention may be configured for connection to such components, or may be manufactured so that one or more waveguides are integrally formed "in-line" with one or more components. It is also possible for waveguides to be made integral with even more complex housings or part-housings for circulators or switch bodies, for example.

Figure 7:
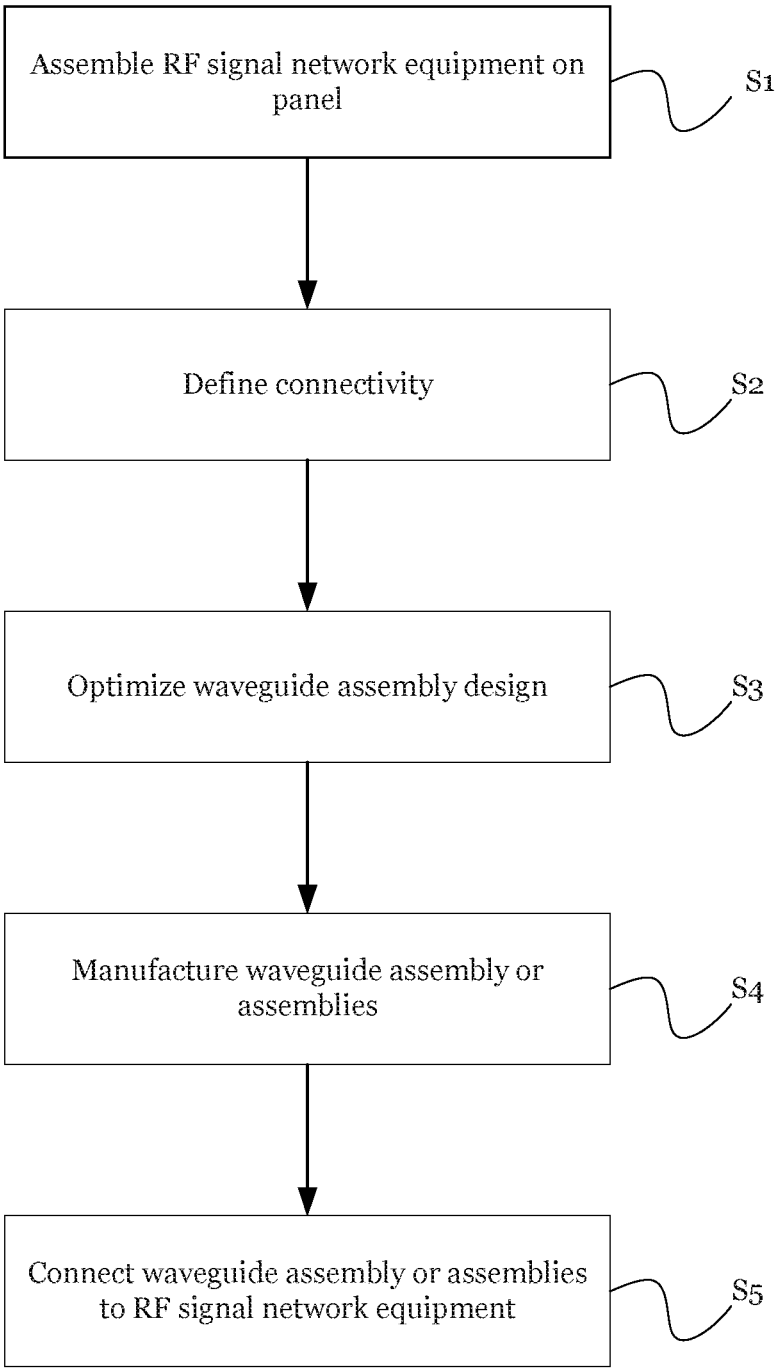
FIG. 7 illustrates a manufacturing method according to embodiments of the present invention.

FIG. 7 illustrates a method of manufacturing an RF signal network including steps of manufacturing a waveguide assembly according to an embodiment of the present invention.

The method starts with step S1, in which equipment required for an RF signal network is arranged on a panel, such as a spacecraft panel. In step S2, the connectivity between the components of the equipment is defined, in order to meet requirements of a particular application. The connectivity may be defined in logical terms, such as that used in the process of defining data flow through or a system, or in the construction of an electrical circuit diagram.

In step S3, an optimization process is performed in order to optimise a realisation of the network connectivity defined in steps S1 and S2 in the form of one or more waveguide assemblies. The optimization process is a process which arranges the required waveguides as groups or assemblies such that the path length of interconnecting waveguides minimises mass and/or cost and/or production time, while making use of maximisation of the density of the waveguides within a given spatial area, and configuring waveguides in multiple layers of a three-dimensional structure. In some embodiments, the optimization process may involve configuring the path length of the interconnecting waveguides to be minimised. In addition to spatial optimization, the optimization may further include optimisations for and thermal and mechanical stability. As described above, since the subsequent manufacturing steps are based on AM, the design constraints which are imposed when conducting the optimisation process are reduced because of the enhanced ability to manufacture a desired structure.

In step S4, the one or more waveguide assemblies are manufactured using AM, as described above, to produce one or more respective standalone structures in each of which at least two waveguides are integrally formed. As alternatives to AM, polymer removal processes may be used. As an alternative to manufacturing one or more waveguide assemblies, it may also be possible to manufacture a mould from which a particular waveguide assembly can be derived.

In addition to manufacturing the waveguides of the waveguide assemblies, auxiliary components such as waveguide interface flanges may be manufactured in step S4, including appropriate fixing mechanisms such as fixing holes or clamp supports. The manufacturing process may also include and necessary plating or painting to be applied to the waveguide assemblies.

In step S5, the manufactured one or more waveguide assemblies are fixed to the panel in order to connect with the signal network components, and/or to interface with other waveguide assemblies. Since the one or more waveguide assemblies are self-supporting structures, only the connection of the assemblies to system components and/or other waveguide assemblies needs to be performed, rather than routing and configuration of each waveguide relative to another waveguide, as in an arrangement such as that shown in FIG. 1.

The method may end at this stage with the construction of the RF signal network. In addition to the steps set out in FIG. 7, however, additional testing steps may be performed. For example, simulations may be performed to ensure that the interface between waveguide assemblies meets the requirements for standard designs. In addition, it may be reviewed whether the waveguides meet particular RF design guidelines, or requirements for withstanding mechanical stress or thermal shock. Such simulations may be particularly applicable for testing a particular network design for suitability in an environment such as space. Once the waveguide assemblies have been manufactured in step S4, testing can be performed as part of an AIT (assembly, integration and test) process.

The techniques described above allow for faster procurements and faster build times than is conventionally possible. Layouts are more compact, which facilitates large, complex multi-beam missions where waveguide routing is traditionally difficult. Savings in procurement and AIT costs can also be significant.

Typical space-based applications for waveguide assemblies of embodiments of the present invention are fixed-satellite services (FSS) and broadcast satellite services (BSS) in Ku and Ka bands. Other applications are multi-beam missions (typically Ka band). It will be appreciated, however, that it is also possible for the waveguide assemblies of the present invention techniques to have terrestrial applications, and applications in other frequency bands.

The skilled person will appreciate that the specific design of a particular waveguide assembly is dependent on the specific application for which it is intended, and the particular components with which the waveguide assembly is to connect or interface. The specific manufacturing process which is to be used to construct the waveguide assembly can be selected accordingly, provided that the process and the constructed waveguide assembly fall within the scope of the invention as defined by the appended claims.

It will be further appreciated from the above description that it is possible to configure the waveguide connectors for waveguide assemblies of embodiments of the present invention in many different ways, depending on particular system requirements such as the number of waveguide ports, the accessibility to the waveguide ports in a particular waveguide assembly, and the particular frequency of the signals to be communicated. It will be appreciated that the waveguide ports of the waveguide connectors may accommodate either rectangular, elliptical, or a combination of both types of waveguides, or waveguides of other cross-sections, and the flanges can be coupled using bolts, clamps, or a combination of both types, depending on fixing requirements and ease of access. It will be further appreciated that different coupling means may also be used which can achieve a coupling pressure required to optimise an interface formed of two connectors of embodiments of the present invention and that clamps and bolts are simply examples.

A number of different waveguide connector designs thus fall within the scope of the claims, based on particular system requirements, and the skilled person will be able to optimise a particular configuration using combinations of features from the embodiments described above, through measurement of RF signal transmission characteristics across an interface formed of such connectors. The skilled person can thus tune the coupling force of a particular waveguide through empirical means. Similarly, the configuration of waveguide ports on the waveguide connector can be determined through empirical means.

The invention claimed is:

1. A waveguide assembly for a radio frequency (RF) signal network, comprising:

a plurality of waveguides, wherein two waveguides of the plurality of waveguides are integrally formed with each other;

wherein a portion of a wall of a first one of the two waveguides is common with a portion B of a wall of a second one of the two waveguides; and a plurality of waveguide connectors, each waveguide connector being coupled to at least three waveguides of the plurality of waveguides and having a flange and at least three ports, each respective port being configured to interface with a respective one of the at least three waveguides, wherein the flange is integrally formed with the at least three waveguides, wherein the plurality of waveguides includes at least one waveguide that provides mechanical support to another of the plurality of waveguides.

2. A waveguide assembly according to claim 1, wherein each of the plurality of waveguides is integrally formed with other waveguides of the plurality of waveguides.

3. A satellite payload comprising:

the RF signal network including a plurality of waveguide assemblies according to claim 1.

4. A waveguide assembly according to claim 1, wherein a portion of any number of the plurality of waveguides has a rectangular cross-section, or an elliptical cross-section.

5. A waveguide assembly according to claim 1, wherein a portion of any number of the plurality of waveguides has a cross-section that varies in size along the portion of any number of the plurality of waveguides and/or is flexible along the length of the at least one waveguide.

6. A waveguide assembly according to claim 1, wherein the at least one waveguide that provides mechanical support comprises:

a mounting structure for providing mechanical strength to the other of the plurality of waveguides, or a wall structure for facilitating thermal radiation from the other of the plurality of waveguides.

7. A waveguide assembly according to claim 1 comprising:

means for interfacing with another waveguide assembly.

8. A waveguide assembly according to claim 1 wherein the plurality of waveguides includes at least one waveguide that is integrally formed with a component for the RF signal network.

9. A waveguide assembly according to claim 1, wherein the plurality of waveguides are arranged to minimize a path length of the plurality of waveguides to provide connectivity for the RF signal network, and to maximize packing density of the plurality of waveguides.

10. A waveguide assembly according to claim 1, wherein the plurality of waveguides are arranged so that a path length of the plurality of waveguides required to provide for connectivity of the RF signal network minimizes mass and/or cost and/or production time of the waveguide assembly.

11. A waveguide assembly according to claim 1 wherein the flange comprises:

means for coupling to a further waveguide connector.

12. A method of manufacturing a radio frequency (RF) signal network comprising:

arranging network equipment on a panel;

defining connectivity between the network equipment;

manufacturing a plurality of waveguide assemblies to achieve a defined connectivity;

wherein a portion of a wall of a first one of at least two waveguides of the plurality of waveguide assemblies is common with a portion of a wall of a second one of the at least two waveguides of the plurality of waveguide assemblies;

each of one or more waveguide connectors having a respective flange, and at least three ports;

each port being configured to interface with a respective waveguide of the plurality of waveguide assemblies such that the respective flange is connected to at least three waveguides of the plurality of waveguide assemblies, wherein the respective flange is integrally formed with the at least three waveguides;

wherein at least one waveguide of the plurality of waveguide assemblies provides mechanical support to at least one other waveguide of the plurality of waveguide assemblies; and connecting the plurality of waveguide assemblies to the network equipment.

13. A method of manufacturing a waveguide assembly for a radio frequency, RF, signal network, comprising manufacturing a plurality of waveguides such that at least two waveguides of the plurality of waveguides are integrally formed with each other, wherein a wall of a first waveguide of the at least two waveguides is common with a wall of a second waveguide of the at least two waveguides; the method comprising:

forming one or more waveguide connectors, each waveguide connector coupled to at least three waveguides of the plurality of waveguides and having a flange integrally formed with the at least three waveguides, and at least three ports, each respective port configured to interface with a respective one of the at least three waveguides; and arranging the plurality of waveguides to minimize a path length of the plurality of waveguides required to provide for connectivity of the RF signal network, and to maximize packing density of the plurality of waveguides.

14. A method according to claim 13, wherein the path length of the plurality of waveguides required to provide for connectivity of the RF signal network minimizes mass and/or cost and/or the production time of the waveguide assembly.

15. A method of manufacturing a waveguide assembly for a radio frequency (RF) signal network, the method comprising:

manufacturing a plurality of waveguides by additive manufacturing such that at least two waveguides of the plurality of waveguides are integrally formed with each other, wherein a portion of a wall of a first one of the at least two waveguides is common with a portion of a wall of a second one of the at least two waveguides; and coupling one or more waveguide connectors to the at least two waveguides, each connector having a respective flange and a respective one plurality of ports, each port being configured to interface with one waveguide of the at least two waveguides.

* * * * *